US007597454B2

(12) United States Patent
Chang et al.

(10) Patent No.: US 7,597,454 B2
(45) Date of Patent: Oct. 6, 2009

(54) CHRISTMAS LIGHT STRING WITH SOCKET FOR CONNECTING TO ANOTHER CHRISTMAS LIGHT STRING

(76) Inventors: Chu-Cheng Chang, No.12, Lane 96, Nanjhong St., Hsinchu City (TW) 30053; Cheng-Fen Chang, No.12, Lane 96, Nanjhong St., Hsinchu County (TW) 30053; Chen-Hsien Chang, No.12, Lane 96, Nanjhong St., Hsinchu City (TW) 30053; Chen-Tao Chang, No.12, Lane 96, Nanjhong St., Hsinchu County (TW) 30053

( * ) Notice: Subject to any disclaimer, the term of this patent is extended or adjusted under 35 U.S.C. 154(b) by 83 days.

(21) Appl. No.: 11/714,207

(22) Filed: Mar. 6, 2007

(65) Prior Publication Data

US 2008/0218092 A1 Sep. 11, 2008

(51) Int. Cl.
*F21S 4/00* (2006.01)
*F21V 21/16* (2006.01)

(52) U.S. Cl. ..... 362/249.01; 362/391; 315/185 S

(58) Field of Classification Search ..... 362/249, 362/653, 654, 391, 249.01, 806; 315/185 R, 315/185 S See application file for complete search history.

(56) References Cited

U.S. PATENT DOCUMENTS

| | | | | |
|---|---|---|---|---|
| 5,639,157 | A * | 6/1997 | Yeh | 362/567 |
| 6,972,528 | B2 * | 12/2005 | Shao | 315/185 R |
| 7,344,275 | B2 * | 3/2008 | Allen et al. | 362/249 |
| 7,501,772 | B2 * | 3/2009 | Chung et al. | 315/185 R |
| 2002/0080609 | A1 * | 6/2002 | Ahroni | 362/252 |
| 2007/0029937 | A1 * | 2/2007 | Janning | 315/66 |
| 2007/0138968 | A1 * | 6/2007 | Chang | 315/185 R |
| 2008/0037249 | A1 * | 2/2008 | Lai | 362/249 |
| 2008/0084695 | A1 * | 4/2008 | Hsu | 362/249 |
| 2008/0211415 | A1 * | 9/2008 | Altamura | 315/192 |

* cited by examiner

*Primary Examiner*—Stephen F Husar
*Assistant Examiner*—Peggy A. Neils
(74) *Attorney, Agent, or Firm*—Bacon & Thomas, PLLC

(57) ABSTRACT

A Christmas light string is disclosed and includes a plug a power socket, a first cord electrically interconnecting the plug and the power socket, a second cord extending from the plug and being electrically connected thereto, an adapter proximate the plug and mounted in the second cord, and a plurality of lamps electrically connected in series or parallel and mounted along the second cord and distal the plug. The plug of another Christmas light string is adapted to electrically connect to the power socket by insertion. Hence, a number of Christmas light strings can be assembled together to form a lighting unit having an increased length.

1 Claim, 3 Drawing Sheets

CHRISTMAS LIGHT STRING WITH SOCKET FOR CONNECTING TO ANOTHER CHRISTMAS LIGHT STRING

BACKGROUND OF THE INVENTION

1. Field of Invention

The invention relates to lighting devices for Christmas and more particularly to a Christmas light string having a socket for electrically connecting to another Christmas light string so that a number of Christmas light strings can be assembled together to form a lighting unit having an increased length.

2. Description of Related Art

There have been numerous suggestions in prior patents for Christmas light string. For example, U.S. Pat. No. 6,344,716 describes a Christmas light string having a plurality of parallel group devices to assure that voltage drop across each five-lamp group is always approximately three volts regardless of the number of bulbs missing, burned out, or whose contacts are degraded.

Further, decorating a Christmas tree with one or more Christmas light strings is well known. Typically, a Christmas light string comprises a plug, an adapter, a plurality of lamps, and a cord connecting them together. In use, the plug is inserted into a wall outlet for electrically connecting to 110 AC volts or 220 AC volts power. The AC power is rectified by the adapter to convert into DC having a voltage of, for example, 24 volts. And in turn, the lamps are powered by 24 DC volts.

However, whether electrically connected in series or parallel, the number of lamps, mounted on a Christmas light string is limited due to the low voltage DC source. And in turn, it limits the length of the Christmas light string. It is often that a person has to prepare a number of Christmas light strings and connect each of them to an independent power source (e.g., a wall outlet or a power strip) in order to increase length if such need arises. However, this not only increases the cost due to, for example, the buying of power strips but also is not practical if there is only one wall outlet available. Thus, the need for improvement still exists.

SUMMARY OF THE INVENTION

It is therefore one object of the invention to provide a Christmas light string having a power socket for electrically connecting to another Christmas light string so that a number of Christmas light strings can be assembled together to form a lighting unit having an increased length.

The above and other objects, features and advantages of the invention will become apparent from the following detailed description taken with the accompanying drawings.

DETAILED DESCRIPTION OF THE INVENTION

Figure 1:
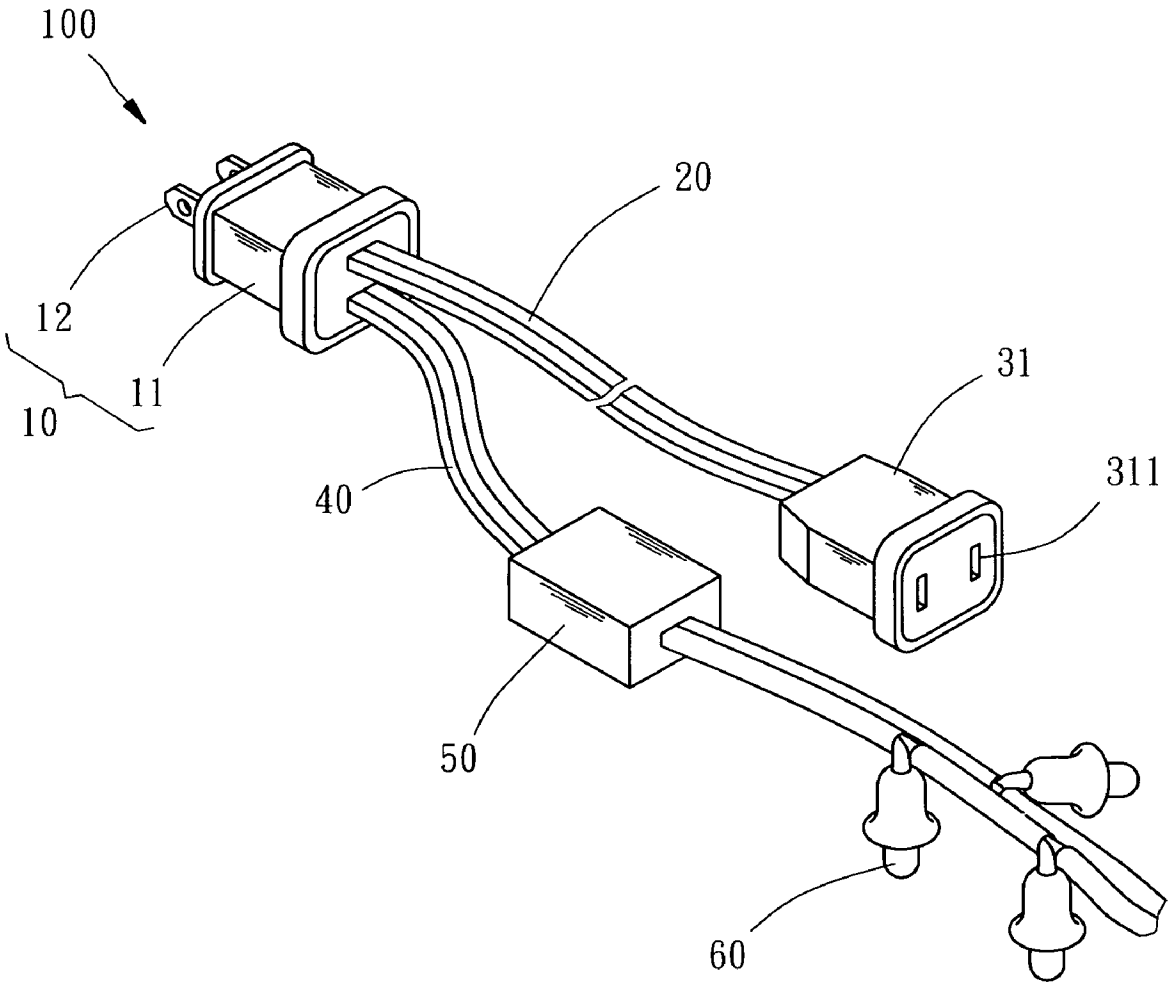
FIG. 1 is a perspective view of a preferred embodiment of Christmas light string according to the invention.
Figure 2:
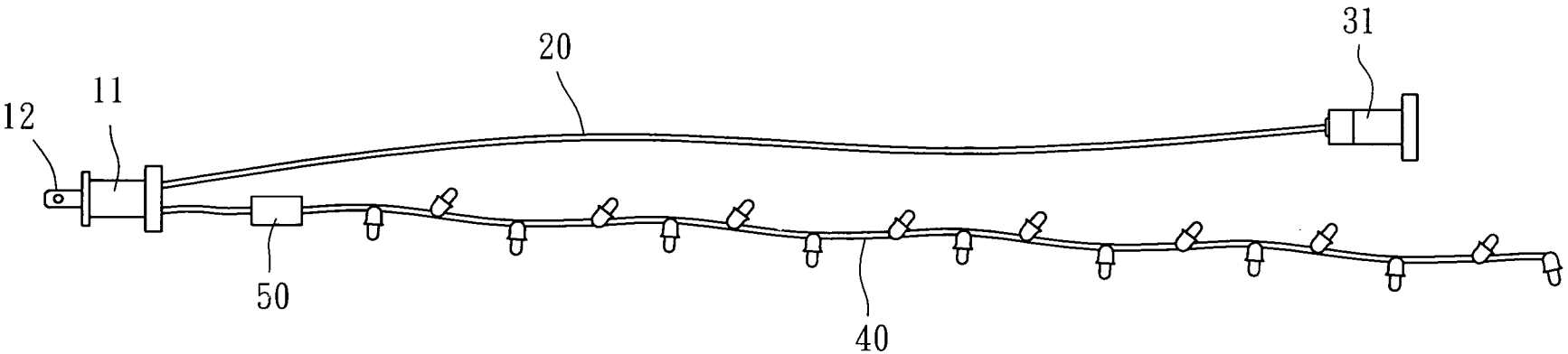
FIG. 2 is a schematic side elevation of FIG. 2.

Referring to FIGS. 1 and 2, a Christmas light string 100 in accordance with a preferred embodiment of the invention comprises a standard plug 10 including an insulative enlargement 11 and two blades 12 projecting from a front face of the enlargement 11; a power socket 31 including two holes 311 on a rear face of its insulative enlargement; and a first cord 20 interconnecting the plug 10 and the socket 31 and being electrically connected to the blades 12.

The Christmas light string 100 further comprises a second cord 40 extending from the plug 10 and being electrically connected to the blades 12 (i.e., the second cord 40 and the first cord 20 being electrically connected in parallel); an adapter 50 disposed in a position of the second cord 40 proximate the plug 10; and a plurality of lamps 60 electrically connected in series or parallel along the second cord 40 and being distal the plug 10.

While the plug 10 has two blades 12 as shown in the preferred embodiment, it is understood that the plug 10 can have three blades 12 in other embodiments without departing from the scope of the invention. Likewise, while the socket 31 has two holes 311 as shown in the preferred embodiment, it is understood that the socket 31 can have three holes 311 in other embodiments without departing from the scope of the invention.

In one configuration of use, the plug 10 is inserted into a wall outlet (not shown) for electrically connecting to 110 AC volts or 220 AC volts power. The AC power is rectified by the adapter 50 to convert into DC having a voltage of, for example, 24 volts. And in turn, the lamps 60 are powered by 24 DC volts.

Figure 3:
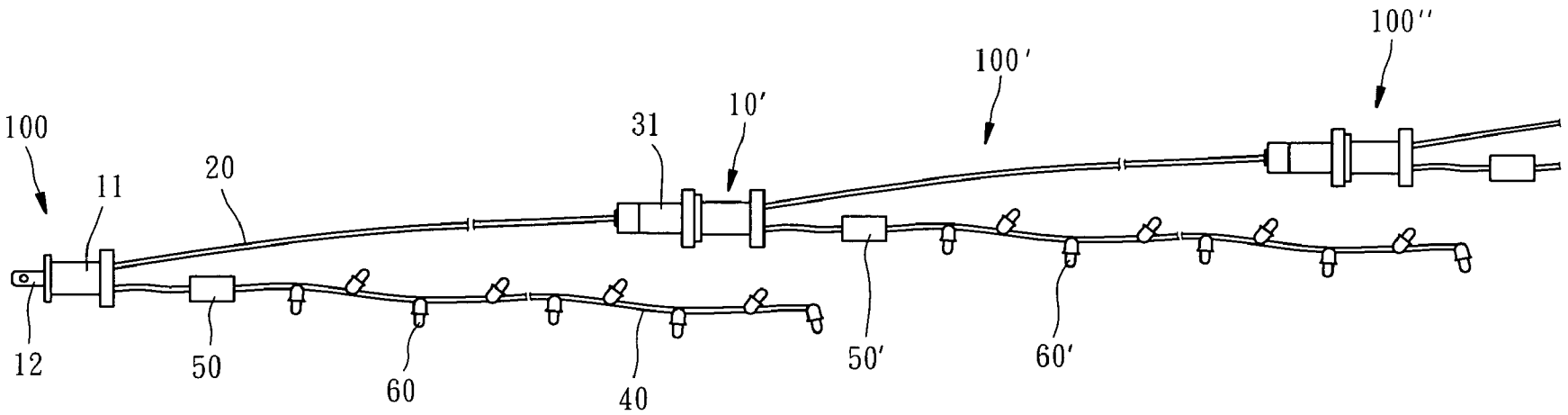
FIG. 3 is a view similar to FIG. 2 showing three Christmas light strings being connected together to form a lighting unit according to the invention.

Referring to FIG. 3, in another configuration of use where a lighting unit having a length longer than the Christmas light string 100 is desired, after electrically connecting the Christmas light string 100 to the wall outlet as stated above, a person may electrically connect an identical second Christmas light string 100' to the Christmas light string 100 by inserting the plug 10' into the socket 31 and further electrically connect an identical third Christmas light string 100" to the second Christmas light string 100' by inserting the plug of the third Christmas light string 100" into the socket of the second Christmas light string 100".

Preferably, light produced by the lamps 60 is substantially the same as that produced by the lamps 60' because, as stated above, the second cord 40 and the first cord 20 are electrically connected in parallel.

While the invention herein disclosed has been described by means of specific embodiments, numerous modifications and variations could be made thereto by those skilled in the art without departing from the scope and spirit of the invention set forth in the claims.

What is claimed is:

1. A Christmas light string comprising:

a plug;

a power socket;

a first cord electrically interconnecting the plug and the power socket;

a second cord extending from the plug and being electrically connected thereto;

a full-wave rectifier proximate to the plug and mounted in the second cord; and a plurality of lamps electrically connected in series or parallel and mounted along the second cord and distal to the plug, wherein the power socket is adapted to electrically connect to the plug of a second Christmas light string.

* * * * *